US009156640B2

(12) United States Patent
Sugizaki

(10) Patent No.: US 9,156,640 B2
(45) Date of Patent: Oct. 13, 2015

(54) SHEET PROCESSING APPARATUS AND COLOR ERASING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Yoshiaki Sugizaki, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/276,333

(22) Filed: May 13, 2014

(65) Prior Publication Data

US 2014/0340460 A1 Nov. 20, 2014

(30) Foreign Application Priority Data

May 14, 2013 (JP) ..... 2013-102623
Apr. 30, 2014 (JP) ..... 2014-094254

(51) Int. Cl.

| | |
|---|---|
| ***B41J 11/00*** | (2006.01) |
| ***B65H 5/26*** | (2006.01) |
| ***B41J 2/325*** | (2006.01) |
| ***B41J 2/32*** | (2006.01) |
| ***B65H 5/06*** | (2006.01) |

(52) U.S. Cl.

CPC ... *B65H 5/26* (2013.01); *B41J 2/32* (2013.01); *B65H 5/062* (2013.01); *B41J 2202/37* (2013.01); *B65H 2402/441* (2013.01); *B65H 2402/63* (2013.01); *B65H 2402/64* (2013.01); *B65H 2404/6111* (2013.01)

(58) Field of Classification Search

CPC ..... B41J 11/0045; B41J 2/00; B41J 2/325; B65H 5/26
USPC ..... 347/171, 179
See application file for complete search history.

(56) References Cited

U.S. PATENT DOCUMENTS

| | | | | |
|---|---|---|---|---|
| 6,860,658 | B2 * | 3/2005 | Tischer | 400/207 |
| 2008/0118270 | A1 * | 5/2008 | Sugiyama | 399/125 |
| 2012/0306983 | A1 * | 12/2012 | Mizutani et al. | 347/179 |
| 2012/0306985 | A1 * | 12/2012 | Iguchi et al. | 347/179 |

FOREIGN PATENT DOCUMENTS

| | | |
|---|---|---|
| JP | 2006-163431 | 6/2006 |
| JP | 2009-015095 | 1/2009 |

* cited by examiner

*Primary Examiner* — Sarah Al Hashimi
(74) *Attorney, Agent, or Firm* — Amin, Turocy & Watson, LLP

(57) ABSTRACT a sheet processing apparatus comprises a main body side guiding module, a first movable module, a second movable module and a connection module. The main body side guiding module guides a sheet. The first movable module moves to a second position to open the conveyance path through motion from a first position opposite to the main body side guiding module, towards a first direction. The second movable module holds a detachable processing module for carrying out a given processing on the sheet, and moves integrally with the first movable module from the first position to the second position. The connection module connects the second movable module with the first movable module in such a manner that the second movable module can move to a third position to expose the processing module through motion from the second position in a second direction opposite to the first direction.

5 Claims, 8 Drawing Sheets

SHEET PROCESSING APPARATUS AND COLOR ERASING APPARATUS

CROSS-REFERENCE TO RELATED APPLICATION

This application is based upon and claims the benefit of priority from Japanese Patent Application No. 2013-102623, filed May 14, 2013, No. 2014-094254 filed Apr. 30, 2014, the entire contents of which are incorporated herein by reference.

FIELD

Embodiments described herein relate to a sheet processing apparatus for processing a sheet color-erased by a color erasing apparatus which erases the color of an image visualized with a color material generating color using a developing material.

BACKGROUND

There is an erasing apparatus for erasing the color of an image by making the color generated by a color material invisible so as to reuse a sheet.

The color erasing apparatus heats the visualized color material so as to reduce the effect of the color developing material to the color generation compound (dye precursor compound) which generates color under the effect of the color developing agent and release (erase) the color generation state.

In addition, as the sheet is not reused if the reuse times exceeds a given reuse times, a marking device is used to carry out marking indicating the reuse times on the color-erased sheet during the color erasing processing so that a user can know the reuse times. In most cases, the marking device is an optional device (individual addition device).

DETAILED DESCRIPTION

In accordance with one embodiment, a sheet processing apparatus comprises a main body side guiding module, a first movable module, a second movable module and a connection module. The main body side guiding module guides a sheet. The first movable module provides a conveyance path for conveying the sheet between the main body side guiding module and the first movable module at a first position opposite to the main body side guiding module, and moves to a second position to open (expose) the conveyance path through motion from the first position towards a first direction. The second movable module holds a detachable processing module for carrying out a given processing on the sheet, and moves integrally with the first movable module from the first position to the second position. The connection module connects the second movable module with the first movable module in such a manner that the second movable module can move to a third position to expose the processing module through motion from the second position in a second direction opposite to the first direction.

Embodiments are described below with reference to the accompanying drawings.

Figure 1:
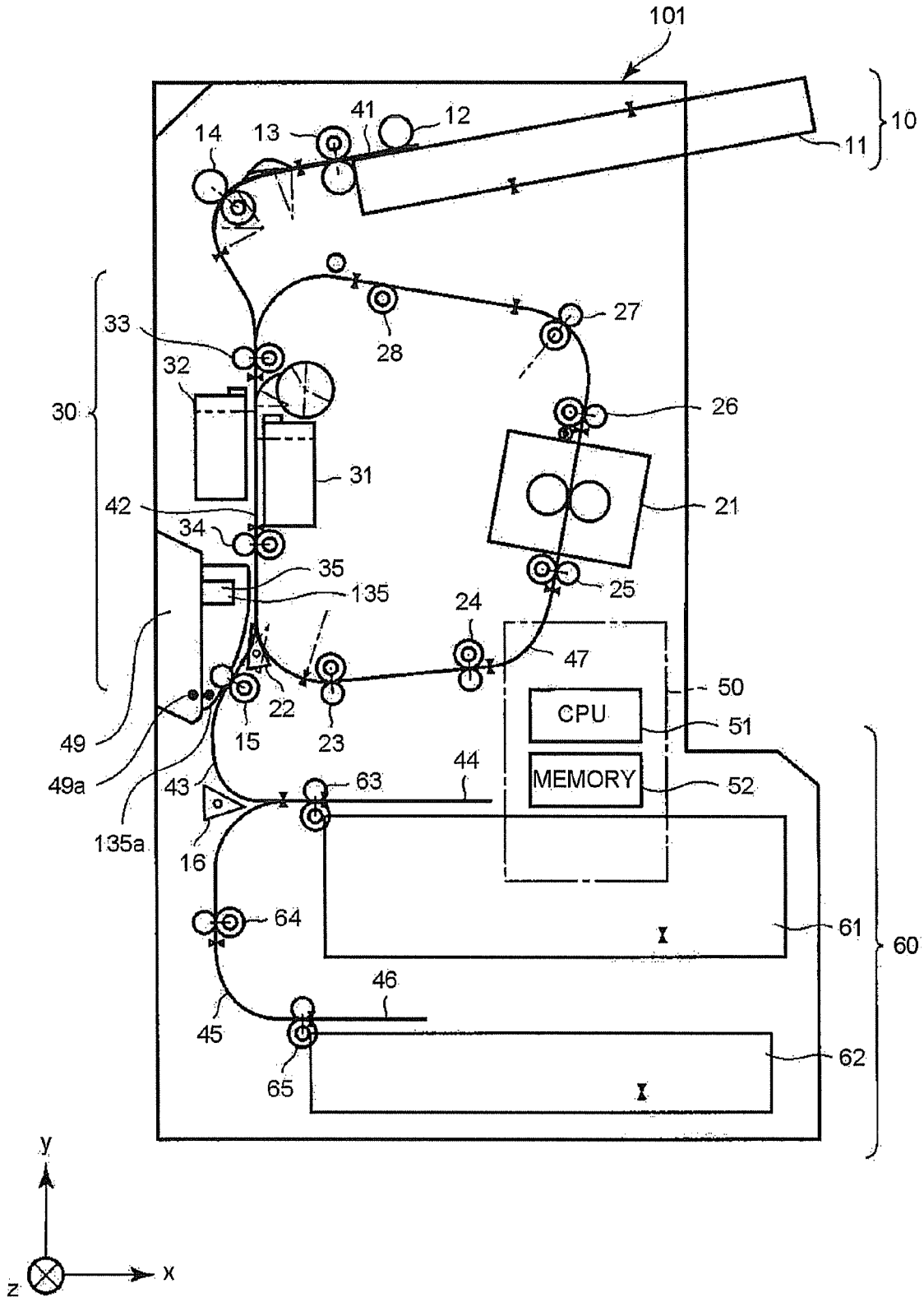
FIG. 1 is a diagram illustrating one example of a color erasing apparatus according to one embodiment.

A color erasing apparatus 101 shown in FIG. 1 includes at least a paper feed section 10, a color erasing section 21, a reading section 30, a conveyance section 40, a control section 50 and a paper discharge section 60.

The paper feed section 10 comprises a color-unerased sheet holding section (hereinafter referred to as a paper feed cassette) 11 for receiving (sheet is set) a color-unerased sheet (paper) on which there is an image (color material) to be erased; a conveyance path 41 (conveyance section 40) for guiding the color-unerased sheet held by the paper feed cassette 11 to the color erasing section 21 which will be described later; and a paper feed roller 12, a conveyance roller 13 and a conveyance roller 14 for applying, to a color-unerased sheet, propulsion (conveyance force) through which the color-unerased sheet can be conveyed (moved) in the conveyance path 41.

The conveyance path 41 is connected with a conveyance path 42 (conveyance section 40) one part of which is shared with the reading section 30 described later.

The conveyance path 42 (conveyance section 40) conveys the color-unerased sheet which is to be guided to the color erasing section 21, or guides a sheet (hereinafter referred to as color-erased sheet) the image on which is color-erased (erase the color generated by the color material) in the color erasing section 21 to the color-erased sheet holding section (hereinafter referred to as paper discharge section) 60. The conveyance path 42 is provided with conveyance rollers 33 and 34 for respectively applying, to the color-unerased sheet and the color-erased sheet, propulsion through which the sheet can be conveyed in the conveyance path 42.

The color erasing apparatus 101 includes a branching device 22 for distributing color-unerased sheets from the conveyance path 42 towards the color erasing section 21 based on a reading result of the reading section 30 described later; a conveyance path 47 (conveyance section 40) for guiding the color-unerased sheet distributed by the branching device 22 to the color erasing section 21; conveyance rollers 23~25 for applying, to the color-unerased sheet, propulsion through which the color-unerased sheet can be conveyed to the color erasing section 21; and conveyance rollers 26~28 for guiding the color-erased sheet subjected to the color erasing processing by the color erasing section 21 to the conveyance path 42. The color erasing section 21 applying a color erasing temperature (heat) above a given temperature to the sheet passing through a nip area between, for example, two rollers which are arranged in such a manner that the axes thereof for defining the center of rotation are actually parallel to each other, or between a roller and an endless belt, so as to reduce the effect of the color developing agent to the color generation compound (dye precursor compound) which generates color under the effect of the color developing agent and release the color generation state, thereby erasing the color. In addition, the color erasing temperature (heat) is provided by, for example, a heater lamp integrated in a roller, or an IH (induction heating) heater which generates induction heat to a metal surface of a roller or a metal layer of a belt.

The reading section 30 comprises a first and a second image sensors 31 and 32 for detecting that the sheet conveyed in the conveyance path 42 is the color-unerased sheet, or detecting the existence of marking (marker) indicating the reuse times in a case where the sheet is a sheet (hereinafter referred to as reuse sheet) which is subjected to the color erasing processing repeatedly.

The first and the second image sensors 31 and 32, which are, for example, image capturing sensors such as CMOS sensors, detect the shape of a sheet conveyed in the conveyance path 42, for example, the change in size (area) with respect to the specified unique size of a sheet such as a bending or a rip, the existence of images on both sides of a sheet and the reuse times indicated by a marker.

The color erasing apparatus 101 includes a marking device (individual addition device) 35 for marking (adding a marker) the reuse times on a sheet. The marking device 35 referred to as an imprinter adds (prints) a marker indicating the reuse times to a sheet with, for example, ink which maintains the color generation state even if heat is applied (to the sheet) by the color erasing section 21.

The image information and the (information of) reuse times indicated by the marker respectively acquired by the image sensors 31 and 32 are converted from the image information to (digital) image data through an A-D (analog-digital) conversion, and then are stored, in an image memory and a NVM (Non Volatile Memory) of a storage device connected with the control section 50, as the image data and reuse times data at a unit of one sheet or one page (surface).

The conveyance path 42 is connected with a conveyance path 43 which guides the color-erased sheet distributed by the branching device 22 to the paper discharge section 60.

The conveyance path 43 (conveyance section 40) including at least a paper discharge branching device 16 and a conveyance roller 15, guides the color-erased sheet distributed by the branching device 22 to either of a first color-erased sheet holding section (hereinafter referred to as reuse sheet cassette) 61 and a second color-erased sheet holding section (hereinafter referred to as stocker) 62 of the paper discharge section 60. The color-erased sheet to be stored in the reuse sheet cassette 61 is guided by a conveyance roller 63 and a conveyance path 44 (conveyance section 40). The color-erased sheet to be stored in the stocker 62 is guided by conveyance rollers 64 and 65 and conveyance paths 45 and 46 (conveyance section 40, respectively).

A cover 49 of the marking device section is arranged nearby the conveyance path 42 to expose part of the conveyance path 42, so as to, for example, carry out jam processing for the sheet jam of the sheets moving in the conveyance path 42, or to refill ink into the marking device 35. The covers for exposing part of the conveyance path to carry out jam processing for the sheet jam, though not being described in detail, are also arranged nearby the color erasing section 21, the first and the second image sensors 31 and 32, and the like.

The control section 50 includes a CPU (Central Processing Unit, control unit) 51; a color erasing amount determination section, a shape determination section, an input/output (I/O) port, a motor driving section, a conveyance path switching control section and a temperature control section which are all connected with the CPU (control unit) 51.

A memory (storage device) 52 is also connected with the CPU 51. The storage device (memory) 52 includes an image memory (page memory), a ROM (Read Only Memory (for program)), a RAM (Random Access Memory, Rewritable memory) and a NVM (nonvolatile memory) and the like.

The control section 50 is further provided with an operation section for receiving an instruction input indicating the ON/OFF of the main power source or the start of a color erasing operation, and the like; and a display section for displaying operations corresponding to the instruction input in the operation section, a specified UI (User Interface) relating to a user processing, for example, the timing for refilling ink to the marking device 35, sheet jam at any position in the conveyance section 40, the procedure of the processing in the jam (sheet jam), and the like. Further, a touch panel type in which the operation section and the display section are integrated into one single body is preferred. The marking device 35 may be of such a type that the marking device 35 itself is exchanged to refill ink, instead of exchanging a cartridge, and in this case, the exchanging timing of the marking device 35 is also displayed.

The control unit (CPU) 51 controls the operation of each section according to the operation program stored in the ROM of the storage device 52.

The ROM stores the operation program for operating the color erasing section 21, reference values used for the comparison with the detection result of the first and the second image sensors 31 and 32, and the like.

The RAM receives an input from JAM sensors which are arranged, to detect jam (sheet jam), at specified positions of each conveyance path 41~47 (conveyance section 40) input through the I/O port, and stores, for example, temporary data generated during the execution of the processing routine according to the instruction input (operation information) from the operation section.

The I/O port converts, for example, the instruction input from the operation section so that the content of the instruction input can be processed by the control unit 51. The I/O port further contributes to receiving control instructions to various components included in the paper discharge section 60 such as motors and branching devices, and receiving detection values detected by any sensor.

The operation section receives, for example, an input of a control instruction from the user, and outputs the control command corresponding to the control instruction so that the control command can be read by the control unit 51.

The storage device 52 stores the image data before color erasing processing corresponding to the image information before color erasing processing of the sheet to be color-erased detected by the first and the second image sensors 31 and 32, and the reuse times indicated by the marker.

The paper discharge section 60 guides the color-erased sheet from the conveyance path 43 to either of the reuse sheet cassette 61 and the stocker 62 through the branching device 16.

An example is briefly described below in which the color generated by the toner on the sheet having a visible image (toner image) formed with color erasable toner is erased, and the sheet is stored in either of the reuse sheet cassette 61 and the stocker 62.

The sheet held by the paper feed cassette 11 is moved from the conveyance path 41 to the conveyance path 42, and if a toner image (image) is detected by either of the first and the second image sensors 31 and 32, the sheet is further moved to the color erasing section 21 via the conveyance path 47.

The sheet of which the color generated by the toner is erased by the color erasing section 21 passes through the conveyance paths 42 and 43, and then is moved to either of the reuse sheet cassette 61 and the stocker 62 via the path provided with the conveyance roller 63 and the branching device 16 which carries out a switching processing according to the setting stored in the rewritable memory (RAM) indicating whether to store the sheet in the reuse sheet cassette 61 or the stocker 62.

Hereinafter, under the control of the control unit 51, the image data before color erasing processing stored in the storage device 52 is compared with the image data after color erasing processing read by the first and the second image sensors 31 and 32 of the reading section 30 again after the color erasing processing carried out by the color erasing section 21, so as to determine the existence of a color erasing residual image.

In a case where the degree of the color erasing residual image (level/image residual amount) is at a level (image residual amount) at which the sheet can be reused, the sheet is moved to the paper discharge section 60 after being added (printed), by the marking device 35, with a marker obtained by adding "1" to the reuse times read from a former marker before the (former) conveyance to the color erasing section 21. In a case where the image residual amount of the color erasing residual image exceeds the level (residual amount) at which the sheet can be reused, the sheet is conveyed to the color erasing section 21 again. In addition, if it is determined that the sheet is reused for so many times that the sheet cannot be reused again, the sheet is conveyed to the stocker 62 in the paper discharge section 60 after the storage (for example, discard flag setting on data) based on the RAM, even if the residual amount of the color erasing residual image is at a level (image residual amount) at which the sheet can be reused.

Further, in the color erasing apparatus shown in FIG. 1, it is possible that, for example, the reading section 30 is omitted, and the color of the color material of the toner from the toner images on all the sheets passing through the color erasing section 21 is erased.

Next, the opening/closing of the cover 49 for removing the sheets jammed in the marking device and the head exchange of the marking device are described with reference to FIG. 2(*a*) and FIG. 2(*b*)~FIG. 8(*a*) and FIG. 8(*b*).

Figure 2:
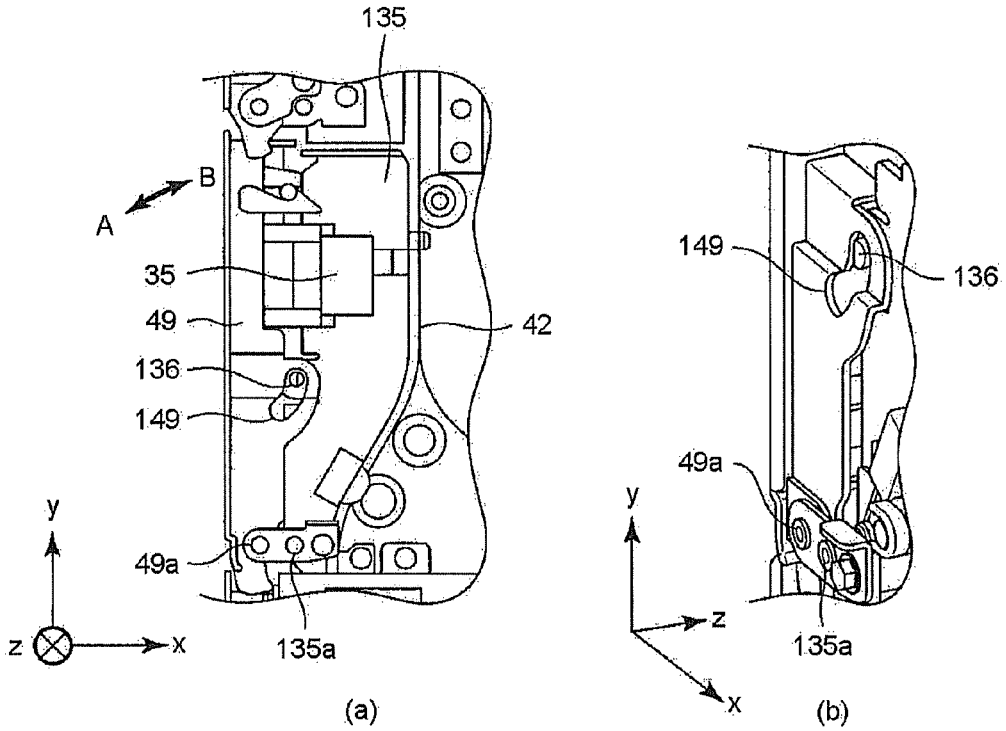
FIG. 2 is a diagram illustrating one example of main portions of the color erasing apparatus according to the embodiment.
Figure 3:
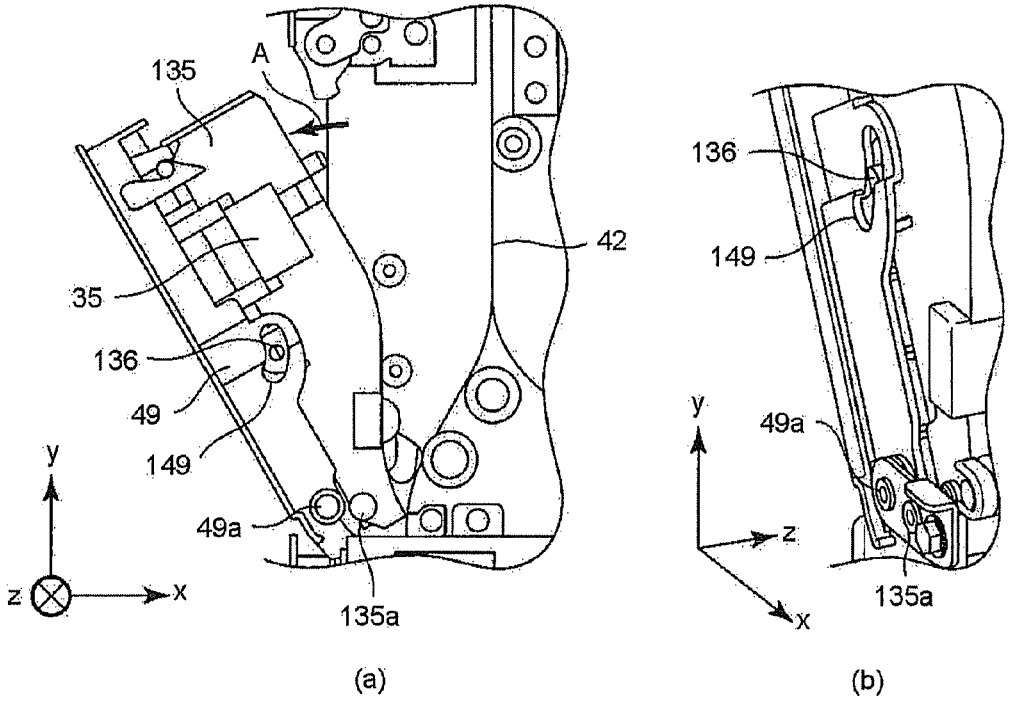
FIG. 3 is a diagram illustrating one example of main portions of the color erasing apparatus according to the embodiment.
Figure 4:
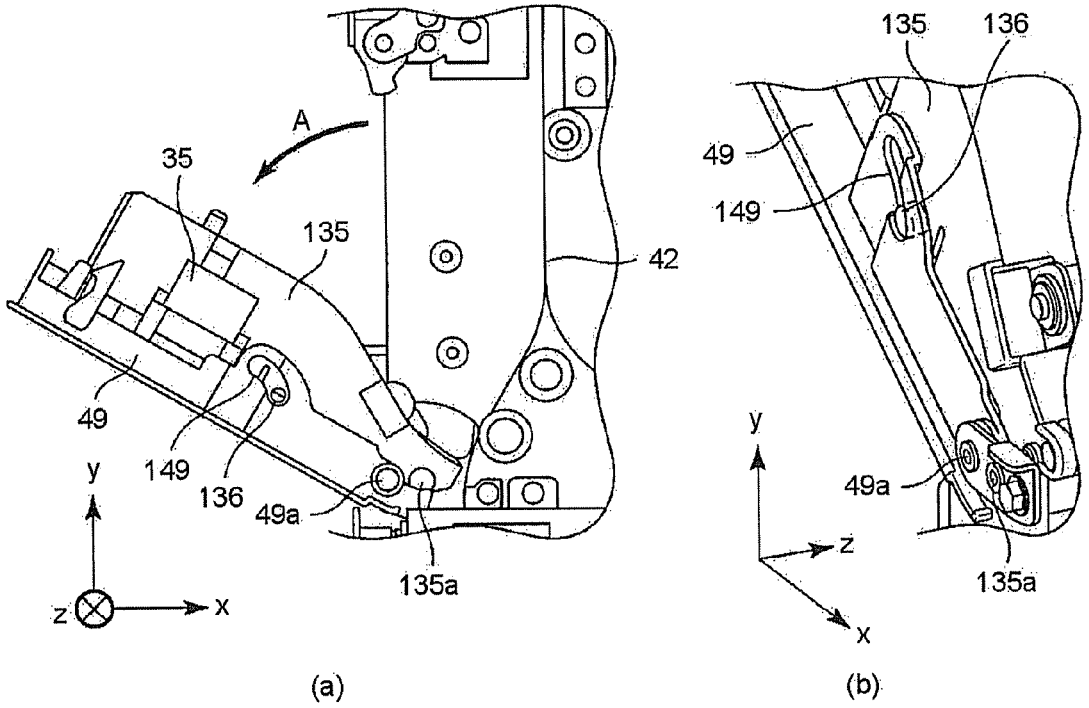
FIG. 4 is a diagram illustrating one example of main portions of the color erasing apparatus according to the embodiment.

The cover 49 can be positioned at a normal position shown by FIG. 2(*a*) and FIG. 2(*b*), that is, a first position where the sheet can be conveyed for the image color erasing operation; a jam processing position shown by FIG. 3(*a*) and FIG. 3(*b*), that is, a third position where the conveyance path is exposed for the sheet jam processing; or an exchange position shown by FIG. 4(*a*) and FIG. 4(*b*) for exchanging the (head part of) marking device, that is, a second position where the marking device 35 can be detached or attached. In addition, the directions indicated by an arrow A and an arrow B in each drawing are two opposite directions in the x-y plane. Further, for the sake of convenience of description, though FIG. 4(*a*) and FIG. 4(*b*) are referred to as the exchange position for exchanging the (head part of) marking device, the jam processing can also be carried out at the position shown by FIG. 4(*a*) and FIG. 4(*b*).

The first position shown in FIG. 2(*a*) shows a state in which the cover 49 is closed (not-opened), and a printer guide 135 for supporting the marking device 35 (head) maintains a (engaging) state in which a pin part 136 positioned at a given position of the same guide 135 is integrated, in an interlocking manner, with a cover side irregular hole (cam hole) 149 (of the cover 49). As shown in FIG. 2(*b*) which is an oblique view viewed in a state where a certain angle is given so that the position relation (engaging state) between the cover side irregular hole 149 and the pin part 136 is clear enough in the x-y plane, the pin part 136 is integrally held within an operation range specified by the cam hole 149 with respect to the opening (closing) operation of the cover 49. The printer guide 135 rotates around a rotation fulcrum 135*a*, and the cover 49 rotates around a rotation fulcrum 49*a*. That is, the rotation fulcrum of the printer guide 135 is different from that of the cover 49. The position relation between the pin part 136 and the irregular hole 149 is described in detail later with reference to FIG. 6A~FIG. 6C.

FIG. 4(*a*) and FIG. 4(*b*) shows the second position (position where the opening angle is the largest), that is, a state in which the cover 49 is opened (pulled down towards the left side in the state shown in FIG. 1) in the direction indicated by the arrow A to a given position for the jam processing, via the middle position shown in FIG. 3(*a*) and FIG. 3(*b*) where the connection between the irregular hole 149 and the pin part 136 is not released. In FIG. 4(*a*) and FIG. 4(*b*), the printer guide 135 is synchronously opened (maintaining the integrated state) in the (engaging) state in which the pin part 136 is integrated with the cover side irregular hole (cam hole) 149 (of the cover 49). As shown in FIG. 4(*b*) which is an oblique view viewed in a state where a certain angle is given, the cover side irregular hole 149 positions the pin part 136 within the operation range specified by the cam hole 149 with respect to the opening operation of the cover 49 at the second position in the x-y plane. That is, the opening amount (opening angle) of the cover 49 is within a given area (operation range), and the pin part 136 of the guide 135 is integrally moved (opened) with the cover 49 by interlocking with the opening operation of the cover 49.

Figure 5:
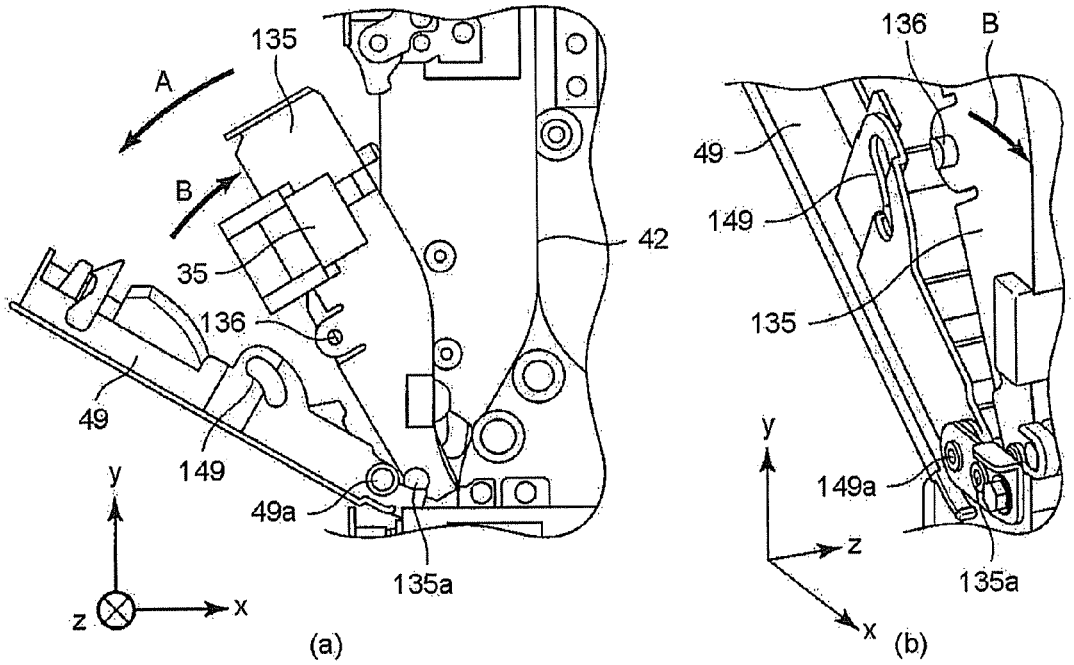
FIG. 5 is a diagram illustrating one example of main portions of the color erasing apparatus according to the embodiment.

FIG. 5(*a*) and FIG. 5(*b*) shows a state in which the printer guide 135 is returned from the second position shown in FIG. 4(*a*) and FIG. 4(*b*) to a given position (for example, the third position where the printer guide 135 is positioned in FIG. 3(*a*)) in the direction indicated by the arrow B opposite to the direction indicated by the arrow A in the x-y plane. As shown in FIG. 4(*b*), if the cover 49 and the printer guide 135 are positioned at the second position, the pin part 136 can be separated from the irregular hole 149. Thus, in the state in which the cover 49 is positioned at the second position, the printer guide 135 can be moved into the state shown in FIG. 5(*a*).

That is, the printer guide 135 positioned at the second position shown in FIG. 4(*a*) is in a state in which it can be moved in the direction indicated by the arrow B shown in FIG. 5(*a*). In other words, in a state of maintaining the cover 49 at the second position shown in FIG. 4(*a*) and FIG. 4(*b*), the printer guide 135 can be separated from the cover 49 and moved in the direction indicated by the arrow B.

Though the printer guide 135 is synchronously opened (maintaining the integrated state) in the (engaging) state in which the pin part 136 is integrated with the cover side irregular hole 149, the pin part 136, as shown in FIG. 5(*b*) which is an oblique view viewed in a state where a certain angle is given in the x-y plane, is positioned within the operation range practically specified from the regulation (position) based on the cam hole 149 of the cover 49. That is, the guide 135 (pin part 136) is integrally moved (opened) with the cover 49 by interlocking with the opening operation of the cover 49 until the position shown in FIG. 4(*a*). The guide 135, if positioned at the second position, is released from the regulation based on the cam hole 149 of the cover 49, thus, the guide 135 can be moved towards the direction indicated by the arrow B opposite to the direction indicated by the arrow A.

Figure 6A:
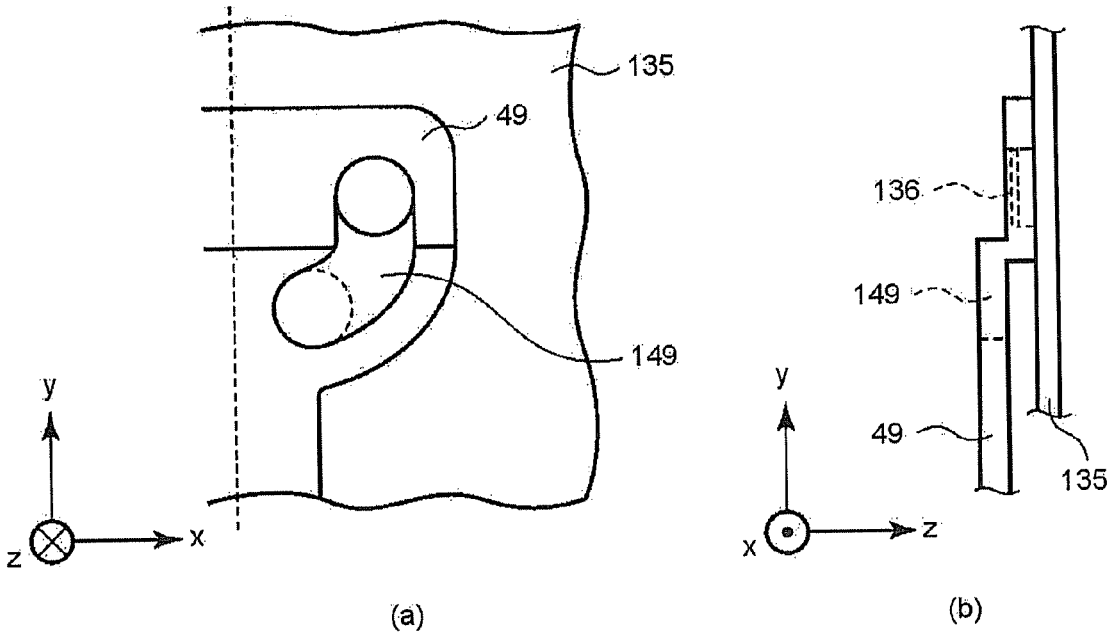
FIG. 6A is a diagram illustrating one example of main portions of the color erasing apparatus according to the embodiment.
Figure 6B:
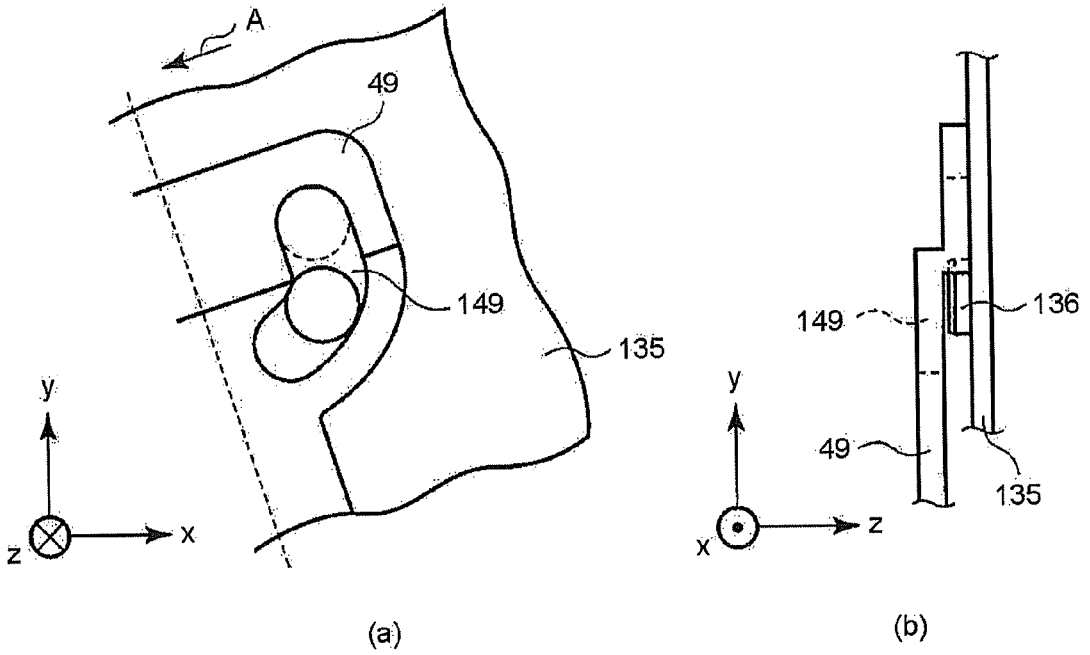
FIG. 6B is a diagram illustrating one example of main portions of the color erasing apparatus according to the embodiment.
Figure 6C:
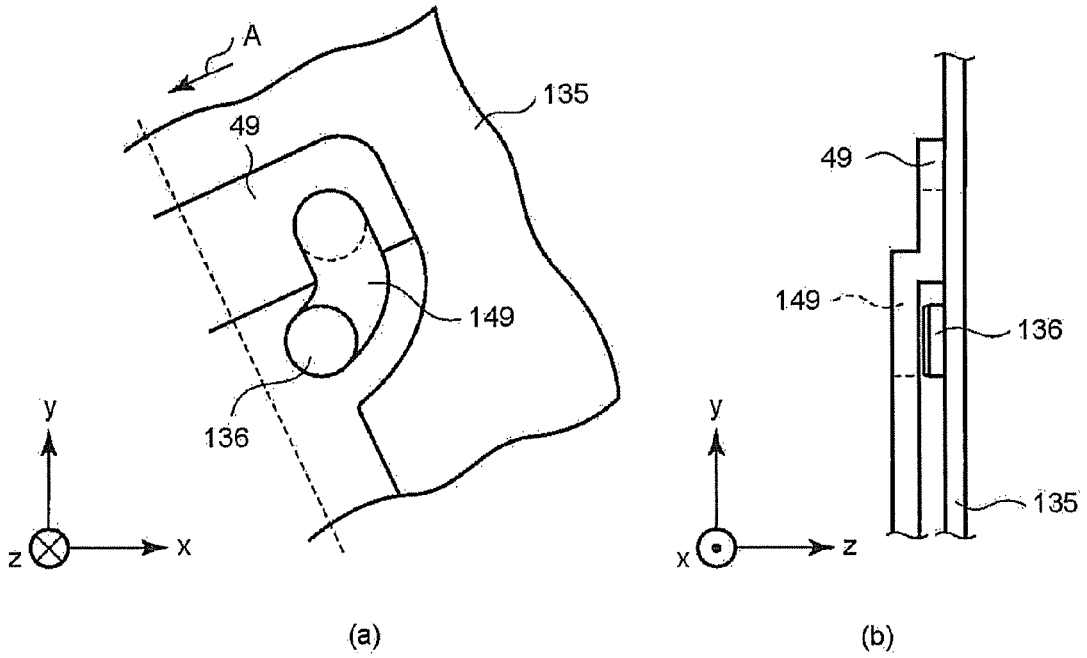
FIG. 6C is a diagram illustrating one example of main portions of the color erasing apparatus according to the embodiment.

That is, in the operation period (normal position), in the state viewed from the x-y plane shown in FIG. 6A(*a*) and in the state viewed from a y-z plane (right side of the state viewed from the x-y plane) orthogonal to the x-y plane shown in FIG. 6A(*b*), the guide 135 holding the marking device 35 is integrated with the cover 49 due to the engaging between the irregular hole 149 of the cover 49 and the pin part 136, and therefore the guide 135 cannot be separated from the cover 49; as shown in FIG. 6B(*a*) and FIG. 6B(*b*), in the state viewed from the y-z plane, as the engaging between the irregular hole 149 and the pin part 136 is still maintained even in the state in which the cover 49 is opened to the middle position, therefore the guide 135 cannot be separated from the cover 49. As shown in FIG. 6C(*a*) and FIG. 6C(*b*), in the state in which the cover 49 is opened completely in the direction indicated by the arrow A, the guide 135 positioned at the rear side of the cover 49 can be opened in the direction indicated by the arrow B. That is, by positioning the cover 49 and the guide 135 at the second position, as shown in FIG. 6C(*a*) and FIG. 6C(*b*), the connection sections (that is, the irregular hole 149 of the cover 49 and the pin part 136) are at a position (the position where the pin part 136 comes off easily) where the irregular hole 149 and the pin part 136 are disconnected in the transverse direction.

Thus, as shown in FIG. 4(*a*), in the state in which the pin part 136 is practically released from the irregular hole 149, the printer guide 135 is in a state of covering on the cover 49 due to the weight thereof; as shown in FIG. 5(*a*), if a user moves the printer guide 135 in the direction indicated by the arrow B, a space can be formed in which the marking device 35 can be detached or attached. Further, with such a constitution described above, during the jam process (for example, FIG. 3(*a*)), it is possible not to expose the internal space in which the marking device 35 can be detached or attached. In addition, by optimizing the height of the pin part 136 (the protrusion amount of the pin part 136 towards the irregular hole 149) or the shape of the pin part 136, or both the height and the shape, in a case of desiring to merely open the cover 49 for the jam processing, the printer guide 135 can be released from the connection (integration) with the cover 49, and the space therebetween can be exposed.

In this way, in the embodiment, a conveyance guide section (marking device 35) and a cover section (cover 49) are respectively rotate (opened/closed) around separate rotation fulcrums, and a connection module for connecting the conveyance guide section and the cover section is provided; in the open area in the openable/closable range, the conveyance guide section and the cover section are connected with each other in an area of more than approximate half, and a state in which the connection is released or is easily to be released for positioning the printer guide 135 to the third position in a state in which the cover 49 is positioned at the second position is provided. Further, the connection module includes the pin part and the irregular hole, and as the phase deviates at a position where the cover section and the guide section are opened, a connection state can be provided in which the pin part is inserted into the irregular hole at a cover closed position and easily comes off from the irregular hole at a cover opened position.

In addition, the irregular hole 149 of the connection module may be positioned at the printer guide 135, and the pin part 136 may be positioned at the cover 49. Further, in a case where there is a plurality of connection modules, the combination between the pin part and the irregular hole for each connection module may be different.

Figure 7:
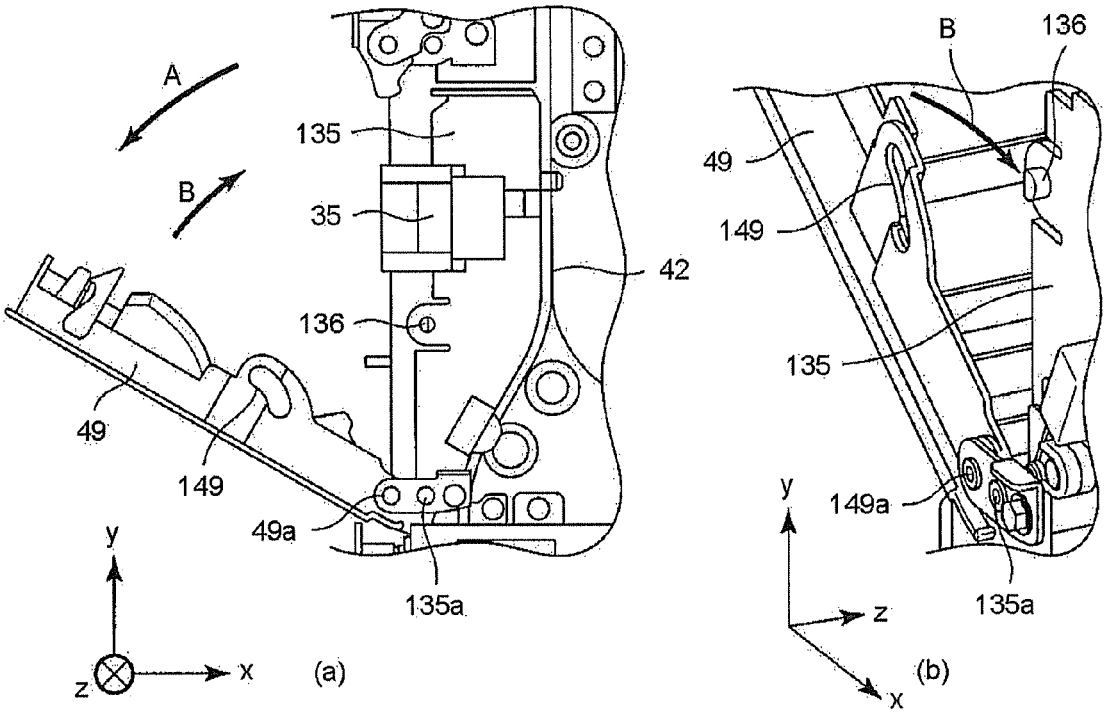
FIG. 7 is a diagram illustrating one example of main portions of the color erasing apparatus according to the embodiment.

FIG. 7(*a*) and FIG. 7(*b*) shows a state in which the printer guide 135 is erected at the side of the conveyance path 42 by further moving the guide 135 in the direction indicated by the arrow B from the state shown in FIG. 5(*a*) and FIG. 5(*b*) so as to, for example, exchange the marking device (individual addition device). That is, FIG. 7(*a*) and FIG. 7(*b*) shows a state in which the space for exchanging the marking device 35 is exposed so that the marking device 35 can be detached and attached in the space between the cover 49 and the guide 135.

The printer guide 135 is moved in the direction indicated by the arrow B, thereby erecting (stabilizing) the printer guide 135 and the marking device 35 at the position shown in FIG. 7(*a*).

Figure 8:
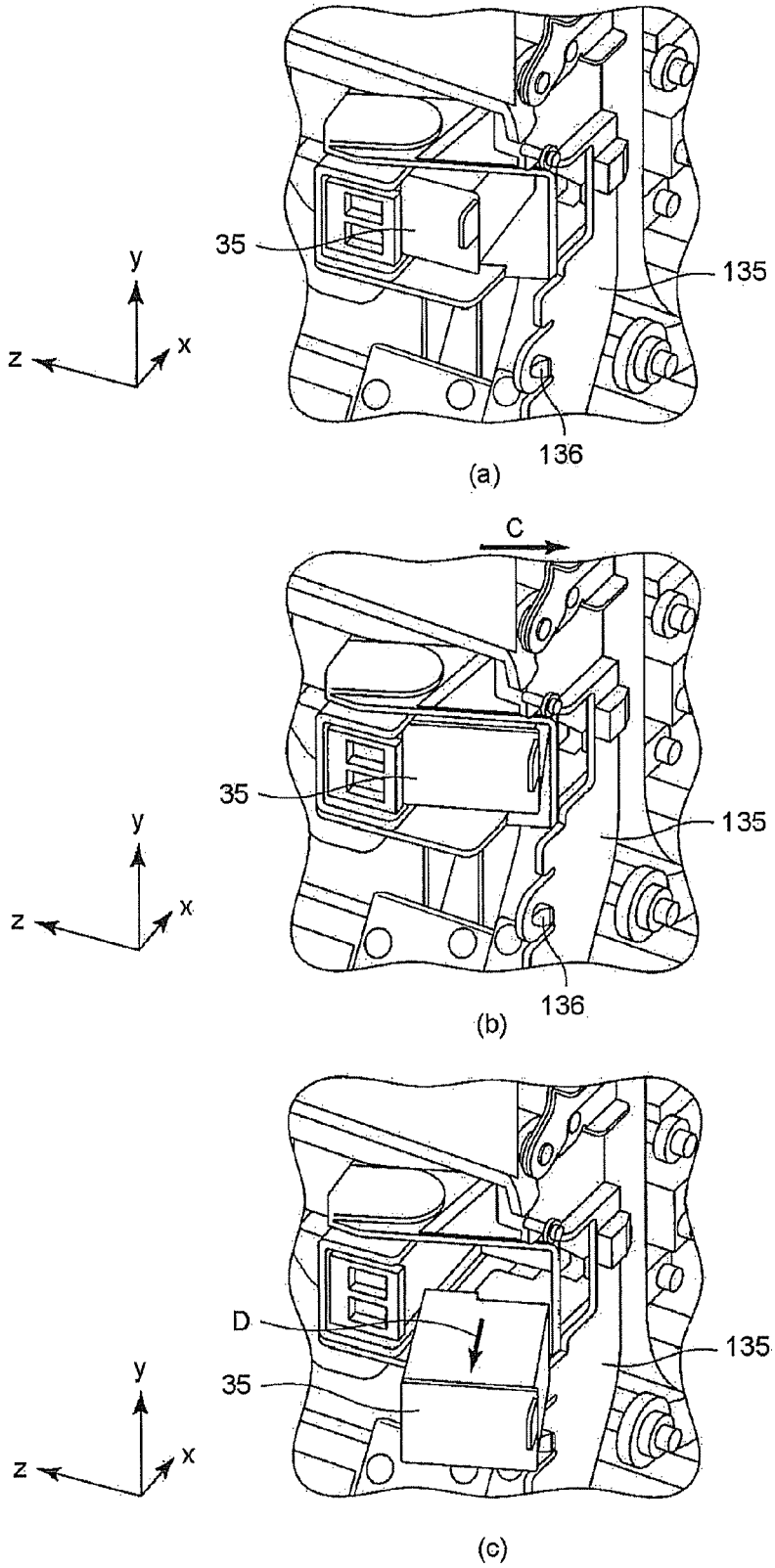
FIG. 8 is a diagram illustrating one example of main portions of the color erasing apparatus according to the embodiment.

The marking device 35 can be detached according to the marking device exchanging procedure shown in FIG. 8(*a*)~FIG. 8(*c*). That is, by moving (pulling the marking device towards the direction indicated by an arrow C) the marking device 35 at the operation position (FIG. 8(*a*)) towards an unlocking position (moving the marking device 35 towards the direction indicated by the arrow C) shown in FIG. 8(*b*), the marking device 35 can be moved to a head removing position indicated by an arrow D shown in FIG. 8(*c*). In addition, an opposite procedure is carried out to install the marking device 35.

That is, by applying the embodiment, there is no need to arrange a dedicated opening portion and a lock mechanism or a lever and the like for the individual addition device needing user processing, which prevents the increase in the apparatus cost. In addition, the workability (convenience) of the user processing carried out for a user processing device such as the individual addition device can be improved as well.

Figure 9:
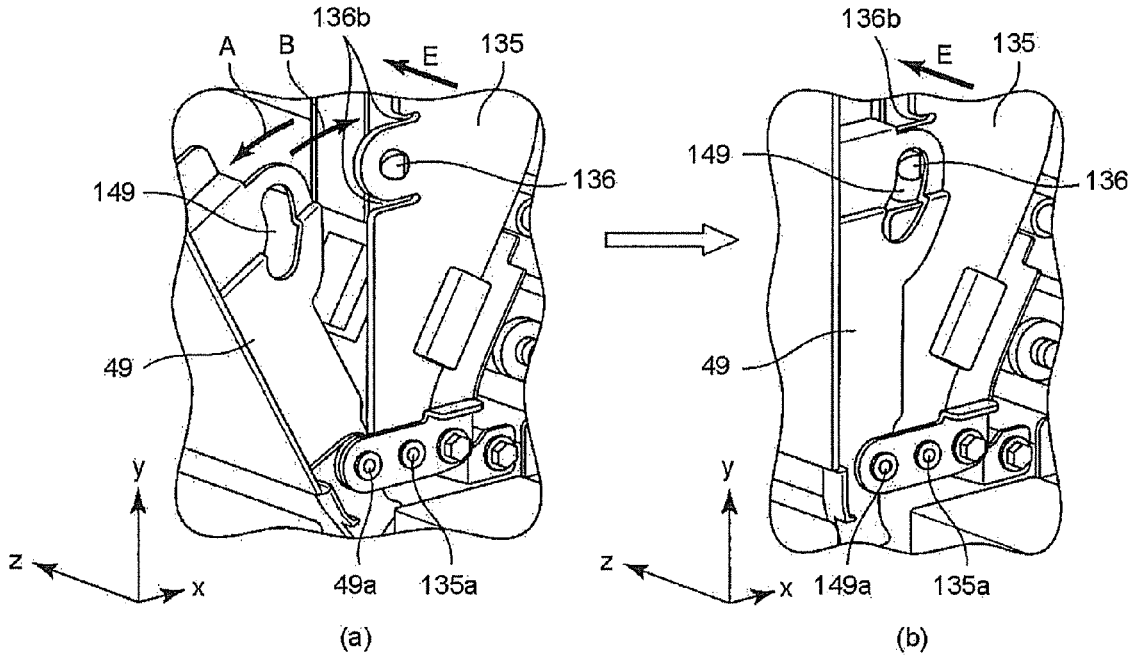
FIG. 9 is a diagram illustrating one example of main portions of the color erasing apparatus according to the embodiment.

FIG. 9(*a*) and FIG. 9(*b*) show features of the shape of the pin part of the printer guide.

As shown in FIG. 9(*a*), the pin part 136 of the printer guide 135 includes, for example, a chamfered (C cut) inclined portion 136*a*. With the inclined portion 136*a*, the cover 49 moving in the direction indicated by the arrow B can returns to the engaging (connection position) with the pin part 136 easily, and through the motion in the direction indicated by the arrow B, the peripheral area of the irregular hole 149 gets over the pin part 136, and the force required to position the pin part 136 in the irregular hole 149 can be reduced.

That is, by arranging the inclined portion (an area that can reduce the resistance to the moving cover 49) 136*a* on the pin part 136, the peripheral area of the irregular hole 149 of the cover 49 moving in the direction indicated by the arrow B can get over the pin part 136 easily from the side of the inclined portion 136*a*.

In addition, slits 136*b* are arranged at given positions of a printer guide 135 where the pin part 136 is positioned, for example, positions equidistant from the center of the pin part 136, thereby achieving elastic deformation towards the direction indicated by an arrow E (y-z plane, that is, the direction generally orthogonal to the moving direction of the cover); thereby reducing the resistance to the peripheral area of the irregular hole 149 of the cover 49 when the peripheral area of the irregular hole 149 of the cover 49 moving in the direction indicated by the arrow B gets over the pin part 136 from the side of the inclined portion 136*a*.

In this way, in a case of returning the cover 49 to the original position when the exchange of the marking device 35 is completed, the cover 49 can be returned to the normal position (first position) shown in FIG. 2(*a*) only by moving the cover 49 in the direction indicated by the arrow B as it is, even in a state in which the printer guide 135 is erected as shown in FIG. 7(*a*).

Figure 10:
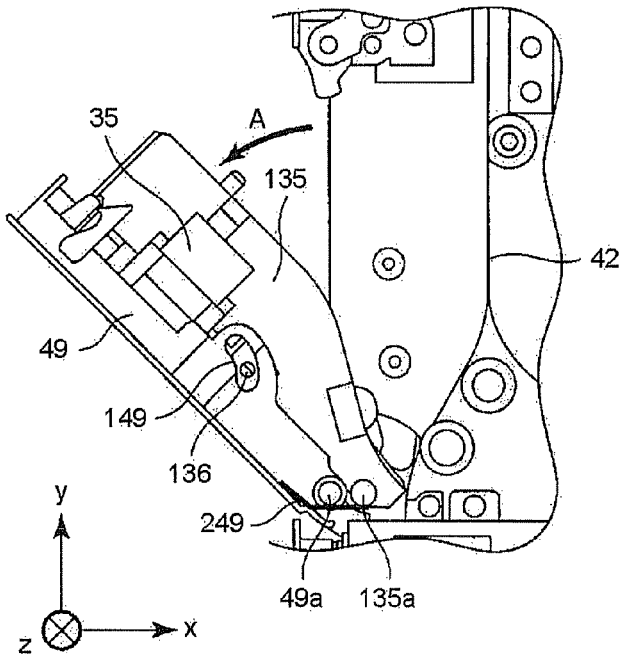
FIG. 10 is a diagram illustrating one example of main portions of the color erasing apparatus according to the embodiment.
Figure 11:
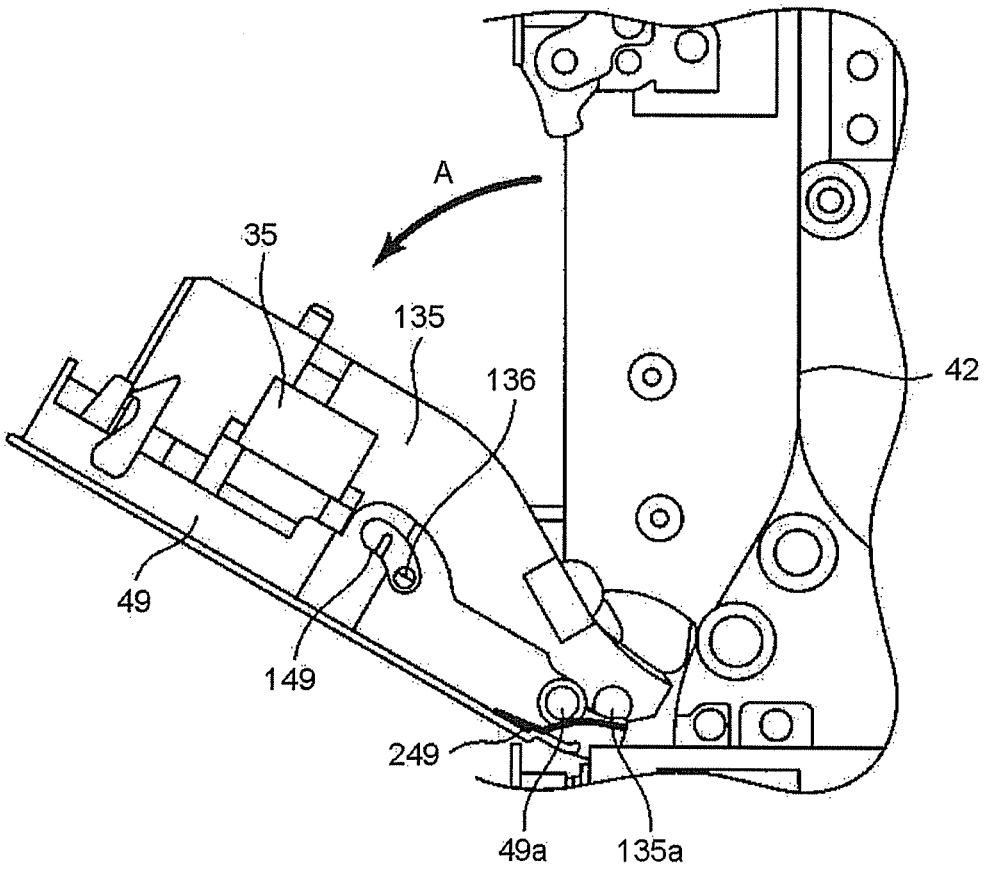
FIG. 11 is a diagram illustrating one example of main portions of the color erasing apparatus according to the embodiment.

FIG. 10 and FIG. 11 are diagrams illustrating one example of features of the effective structure in a state in which the printer guide is integrated with the cover.

The second position described in FIG. 4(*a*) is a position where the cover 49 bears all the weight of the printer guide 135. Thus, for example, by arranging a stopper member 249 including an elastic body in the shape of a flat spring, it can be prevented that the cover 49 is opened to the largest opening position in the direction indicated by the arrow A in one operation due to the total weight of the cover and the printer guide. That is, in a case of desiring to merely open the cover 49 for the jam processing, it can be prevented that the printer guide 135 is opened and released from the connection with the cover 49 in one operation due to the total weight of the cover and the printer guide, and the space between the marking device 35 and the cover 49 is exposed undesirably (refer to FIG. 10).

In addition, in a case where the stopper member 249 is an elastic body in the shape of a flat spring, the cost for fixing the stopper member can be reduced by, for example, sharing the rotation fulcrum 49*a*.

Further, by making the stopper member 249 an elastic body in the shape of a flat spring, in a case of opening the cover 49 to the largest opening position, the cover 49 can be opened to the largest opening position shown in FIG. 11 (FIG. 4(*a*)) only by further applying a force in the direction indicated by the arrow A to the cover 49 from the third position shown in FIG. 10 (FIG. 3(*a*)).

That is, by using the stopper member 249, in a general cover opening (jam processing) operation, a temporary opening stop force is applied (the state shown in FIG. 3(*a*)) at a position where the marking device 35 between the printer guide 135 and the cover 49 is not opened to the exposed position, and a position (FIG. 4(*a*)) where the guide 135 can be released from the connection with the cover 49 can be provided by further applying an opening force (moving the cover 49 in the direction indicated by the arrow A).

In this way, by arranging an inclined portion which can reduce the resistance to the irregular hole moving towards the pin part of the connection module, the workability (usability) when exchanging an optional part (individual addition device) needing a user processing can be improved. In addition, by making the member supporting the pin part in the connection module elastically deformable in the direction generally orthogonal to the moving direction of the cover, the workability of the user processing can be further improved.

That is, by applying either or both of the components shown in FIG. 9(*a*) and FIG. 9(*b*) and the component shown in FIG. 10, the workability of the user processing can be improved, and when the user processing is completed, the cover and the like can be easily and correctly returned to the operation position, and the operation failure caused by, for example, that the user forgets to return the cove by some chance (or the cover is moved to an incomplete position different from the normal position) can be prevented.

In accordance with the embodiment described above, in the color erasing apparatus for erasing the color of the image visualized with an image developing material, that is, a color material and the sheet processing apparatus for processing the sheet the color of which is erased by the color erasing apparatus, it is possible to reduce the cost of the apparatus and meanwhile to facilitate the user processing carried out for the user processing device needing the user processing.

Further, the workability of the user processing can be improved, and the operation failure caused by, for example, that the cover is moved to an incomplete position different from the normal position when the user processing is completed can be prevented.

The "color erasing processing", though exemplified as erasing the color of the image in the embodiment described above, may also include a meaning of erasing the image. That is, the color erasing apparatus described herein is not limited to an apparatus for erasing the color of the image by heating. For example, an apparatus which erases the color of the image on a sheet by radiating light or an apparatus which erases the color of the image formed on a special sheet may also be applied. Alternatively, the color erasing apparatus may be an apparatus for removing (erasing) the image on a sheet. No specific limitation is given to the color erasing apparatus as long as the color erasing apparatus can make the image on a sheet invisible so as to reuse the sheet.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet processing apparatus, comprising:

a main body side guiding module configured to guide a sheet;

a first movable module configured to provide a conveyance path for conveying the sheet between the main body side guiding module and the first movable module at a first position opposite to the main body side guiding module, and move to a second position to open the conveyance path through motion from the first position towards a first direction;

a second movable module configured to hold a detachable processing module for carrying out adding a mark on the sheet to indicate the reuse times of the sheet, and move integrally with the first movable module from the first position to the second position; and a connection module comprising a rotation fulcrum, wherein the rotation fulcrum couples the second movable module with the first movable module in such a manner that the second movable module can move to a third position to expose the processing module through rotational motion from the second position in a second direction opposite to the first direction.

2. The sheet processing apparatus according to claim 1, wherein the connection module releases, when the second movable module moves in the second direction, the connection between the first movable module and the second movable module so that the second movable module can be moved to the third position.

3. The sheet processing apparatus according to claim 2, wherein the connection module includes a fitting structure which releases the connection between the first movable module and the second movable module at the second position, and only the second movable module can be moved from the second position to the third position.

4. The sheet processing apparatus according to claim 1, wherein the connection module includes an elastic structure for restoring the connection between the first movable module and the second movable module when the first movable module moves in the second direction.

5. A color erasing apparatus, comprising:

a color erasing module configured to eliminate the color generation of a color material constituting an image to erase the color;

a main body side guiding module configured to guide a sheet to the color erasing module;

a first movable module configured to provide a conveyance path for conveying the sheet between the main body side guiding module and the first movable module at a first position opposite to the main body side guiding module, and move to a second position to open the conveyance path through motion from the first position towards a first direction;

a second movable module configured to hold a detachable processing module for carrying out adding a mark on the sheet to indicate the reuse times of the sheet, and move integrally with the first movable module from the first position to the second position; and a connection module comprising a rotation fulcrum, wherein the rotation fulcrum couples the second movable module with the first movable module in such a manner that the second movable module can move to a third position to expose the processing module through rotational motion from the second position in a second direction opposite to the first direction.

* * * * *